US010633805B2

(12) United States Patent
Green et al.

(10) Patent No.: US 10,633,805 B2
(45) Date of Patent: Apr. 28, 2020

(54) GRADE AND SLOPE LOCKOUT FOR EXTENDER MOVEMENT OF CONSTRUCTION MACHINE

(71) Applicant: Caterpillar Trimble Control Technologies LLC, Dayton, OH (US)

(72) Inventors: Francisco Green, New Carlisle, OH (US); Tony Steinhagen, Maple Grove, MN (US); Mark Tarvin, Canton, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 214 days.

(21) Appl. No.: 15/942,143

(22) Filed: Mar. 30, 2018

(65) Prior Publication Data

US 2019/0301110 A1 Oct. 3, 2019

(51) Int. Cl.
*E01C 19/48* (2006.01)

(52) U.S. Cl.
CPC ..... *E01C 19/4873* (2013.01); *E01C 2301/00* (2013.01); *E01C 2301/16* (2013.01)

(58) Field of Classification Search
CPC ..... E01C 19/4873; E01C 2301/00; E01C 2301/16
See application file for complete search history.

(56) References Cited

U.S. PATENT DOCUMENTS 4,722,636 A * 2/1988 Brock ..... E01C 19/4873 404/118
4,948,292 A * 8/1990 Haven ..... E01C 19/008 404/118
5,203,642 A * 4/1993 Heller ..... E01C 19/40 404/118
5,568,992 A * 10/1996 Grembowicz ..... E01C 19/48 404/101
5,924,819 A * 7/1999 Breidenbach ..... E01C 19/42 404/104
6,203,243 B1 * 3/2001 Birtchet ..... E01C 19/42 404/104
6,595,719 B1 * 7/2003 Ohseki ..... E01C 19/48 404/118
9,624,626 B1 * 4/2017 Schaeding ..... E01C 19/00
(Continued)

*Primary Examiner* — Sze-Hon Kong
(74) *Attorney, Agent, or Firm* — Kilpatrick Townsend & Stockton

(57) ABSTRACT

Systems and methods for implementing a machine control system in a construction machine having an implement with an extender. The machine control system may include an acceleration sensor mounted to the implement and a processor configured to perform various operations. The operations may include determining that the extender is not moving and in response operating under a first control scheme. Operating under the first control scheme may include receiving acceleration data from the acceleration sensor, generating an estimated slope of the implement based on the acceleration data, and modifying a slope of the implement based on the first estimated slope by causing movement of at least one tow arm. The operations may also include determining that the extender is moving and in response operating under a second control scheme. Operating under the second control scheme may include maintaining the slope of the implement substantially constant.

20 Claims, 8 Drawing Sheets

(56) References Cited

U.S. PATENT DOCUMENTS

| | | | | |
|---|---|---|---|---|
| 2010/0150650 | A1* | 6/2010 | Buschmann | E01C 19/48 404/82 |
| 2010/0150651 | A1* | 6/2010 | Buschmann | E01C 19/48 404/82 |
| 2010/0209190 | A1* | 8/2010 | Munz | E01C 19/48 404/118 |
| 2011/0085859 | A1* | 4/2011 | Yost | E01C 19/004 404/84.5 |
| 2011/0091278 | A1* | 4/2011 | Munz | E01C 19/40 404/118 |
| 2013/0294833 | A1* | 11/2013 | Engel | E01C 19/48 404/118 |
| 2014/0186115 | A1* | 7/2014 | Graham | E01C 19/4873 404/75 |
| 2014/0363230 | A1* | 12/2014 | Buschmann | E01C 19/42 404/72 |
| 2015/0139729 | A1* | 5/2015 | Graham | E01C 19/48 404/84.1 |
| 2016/0040369 | A1* | 2/2016 | Wang | E01C 19/48 404/114 |
| 2016/0237629 | A1* | 8/2016 | Rio | E01C 19/22 |
| 2016/0265173 | A1* | 9/2016 | Ellwein | E01C 19/4873 |
| 2017/0233958 | A1* | 8/2017 | Utterodt | E01C 19/48 701/50 |
| 2017/0370051 | A1* | 12/2017 | Comer | E01C 19/48 |
| 2018/0327023 | A1* | 11/2018 | Buschmann | E01C 19/48 |

* cited by examiner

GRADE AND SLOPE LOCKOUT FOR EXTENDER MOVEMENT OF CONSTRUCTION MACHINE

BACKGROUND

Modern construction machines have dramatically increased the efficiency of performing various construction projects. For example, modern asphalt pavers and other road makers have allowed replacement of old roads and construction of new roads to occur on the order of hours and days instead of what once took place over weeks and months. Construction crews also now comprise fewer individuals due to the automation of various aspects of the road construction process. Much of the technological advances of construction machines are owed in part to the availability of accurate sensors that allow real-time monitoring of the condition, position, and location of a machine's components and/or the environment surrounding the machine. Despite the improvements in modern construction machines, new systems, methods, and techniques are still needed.

SUMMARY

In a first aspect of the present invention, a construction machine is provided. The construction machine may include a tractor and a hopper coupled to the tractor. The construction machine may also include an implement coupled to the tractor via at least one tow arm, the implement having an extender. The construction machine may further include an acceleration sensor mounted to the implement. In some embodiments, the construction machine includes one or more processors configured to perform operations. In some embodiments, the operations include determining that the extender is not moving. The operations may also include in response to determining that the extender is not moving, operating under a first control scheme. In some embodiments, operating under the first control scheme includes receiving acceleration data from the acceleration sensor, generating a first estimated slope of the implement based on the acceleration data, and modifying a slope of the implement based on the first estimated slope by causing movement of the at least one tow arm.

In some embodiments, the operations include determining that the extender is moving, and in response to determining that the extender is moving, operating under a second control scheme. In some embodiments, operating under the second control scheme includes maintaining the slope of the implement substantially constant. In some embodiments, the construction machine is an asphalt paver, the implement is a screed, the extender is a screed extender, and the acceleration sensor is an accelerometer. In some embodiments, maintaining the slope of the implement substantially constant includes mechanically locking in place the at least one tow arm. In some embodiments, maintaining the slope of the implement substantially constant includes not receiving new acceleration data from the acceleration sensor. In some embodiments, maintaining the slope of the implement substantially constant includes not generating a new estimated slope of the implement.

In a second aspect of the present invention, a construction machine is provided. The construction machine may include an implement having an extender, an acceleration sensor mounted to the implement, and one or more processors configured to perform operations. In some embodiments, the operations include operating under a first control scheme. In some embodiments, operating under the first control scheme includes receiving acceleration data from the acceleration sensor, generating a first estimated slope of the implement based on the acceleration data, and modifying a slope of the implement based on the first estimated slope. In some embodiments, the operations include determining that the extender is moving and in response to determining that the extender is moving, operating under a second control scheme. In some embodiments, the second control scheme includes at least one operation that is different than an operation of the first control scheme.

In some embodiments, the operations further include determining that the extender is not moving and in response to determining that the extender is not moving, operating under the first control scheme. In some embodiments, modifying the slope of the implement includes causing movement of a tow arm mechanically coupled to the implement so as to modify the slope of the implement. In some embodiments, operating under the second control scheme includes maintaining the slope of the implement substantially constant. In some embodiments, the construction machine includes an angular rate sensor mounted to the implement. In some embodiments, operating under the first control scheme further includes receiving first angular rate data from the angular rate sensor mounted to the implement and generating the first estimated slope of the implement based on one or both of the acceleration data and the first angular rate data. In some embodiments, operating under the second control scheme includes receiving second angular rate data from the angular rate sensor, generating a second estimated slope of the implement based on the second angular rate data but not on data received from the acceleration sensor, and modifying the slope of the implement based on the second estimated slope.

In some embodiments, determining that the extender is moving includes one or more of receiving user input from a user input device to move the extender, receiving extender data from an extender sensor mounted to the implement indicating that the extender is moving, determining that an instruction was sent to an extender actuator to move the extender, receiving a status from the extender actuator that the extender is moving, and analyzing the acceleration data to determine that the extender is moving. In some embodiments, the construction machine is an asphalt paver, the implement is a screed, the extender is a screed extender, the acceleration sensor is an accelerometer, and the angular rate sensor is a gyroscope.

In a third aspect of the present invention, a method of controlling an implement of a construction machine is provided. The method may include operating under a first control scheme. In some embodiments, operating under the first control scheme includes receiving acceleration data from an acceleration sensor mounted to the implement, generating a first estimated slope of the implement based on the acceleration data, and modifying a slope of the implement based on the first estimated slope. In some embodiments, the method may also include determining that an extender of the implement is moving and in response to determining that the extender is moving, operating under a second control scheme. In some embodiments, the second control scheme includes at least one operation that is different than an operation of the first control scheme.

In some embodiments, the method includes determining that the extender is not moving and in response to determining that the extender is not moving, operating under the first control scheme. In some embodiments, modifying the slope of the implement includes causing movement of a tow arm mechanically coupled to the implement so as to modify the slope of the implement. In some embodiments, operating under the second control scheme includes maintaining the slope of the implement substantially constant. In some embodiments, operating under the first control scheme further includes receiving first angular rate data from an angular rate sensor mounted to the implement and generating the first estimated slope of the implement based on one or both of the acceleration data and the first angular rate data. In some embodiments, operating under the second control scheme includes receiving second angular rate data from the angular rate sensor, generating a second estimated slope of the implement based on the second angular rate data but not on data received from the acceleration sensor, and modifying the slope of the implement based on the second estimated slope.

In some embodiments, determining that the extender is moving includes one or more of receiving user input from a user input device to move the extender, receiving extender data from an extender sensor mounted to the implement indicating that the extender is moving, determining that an instruction was sent to an extender actuator to move the extender, receiving a status from the extender actuator that the extender is moving, and analyzing the acceleration data to determine that the extender is moving. In some embodiments, the construction machine is an asphalt paver, the implement is a screed, the extender is a screed extender, the acceleration sensor is an accelerometer, and the angular rate sensor is a gyroscope.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

In the appended figures, similar components and/or features may have the same numerical reference label. Further, various components of the same type may be distinguished by following the reference label with a letter or by following the reference label with a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION

Embodiments of the present disclosure relate to systems, methods, and other techniques for implementing a machine control system in a construction machine having an implement with an extender. Among other functions, the machine control system may control the slope of the implement to ensure a smooth interaction with the construction machine's environment, which may be important for certain implementations of the construction machine. If the extender is not moving, the machine control system may operate under a first control scheme in which acceleration data from an acceleration sensor mounted to the implement is trusted and relied on to generate slope estimates of the implement. On the other hand, if the extender is moving, the machine control system may operate under a second control scheme in which acceleration data is either completely ignored or less emphasized in any slope estimate of the implement. In one particular implementation, the machine control system is implemented in an asphalt paver having a tractor, a hopper for holding paving material coupled to the tractor, and a screed mechanically coupled to the tractor via at least one tow arm.

Figure 1A:
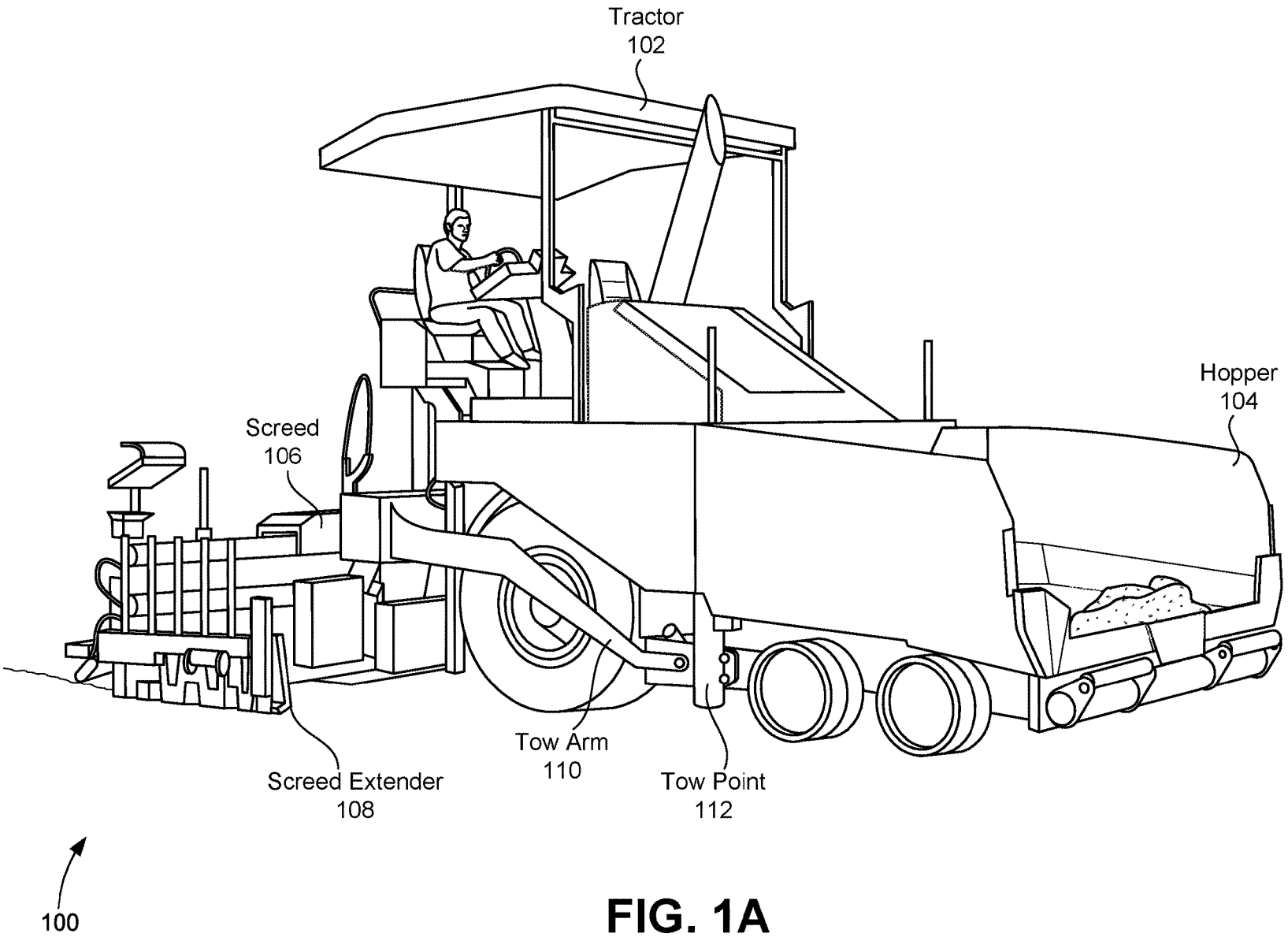
FIGS. 1A and 1B illustrate perspective views of an asphalt paver, according to some embodiments of the present disclosure.
Figure 1B:
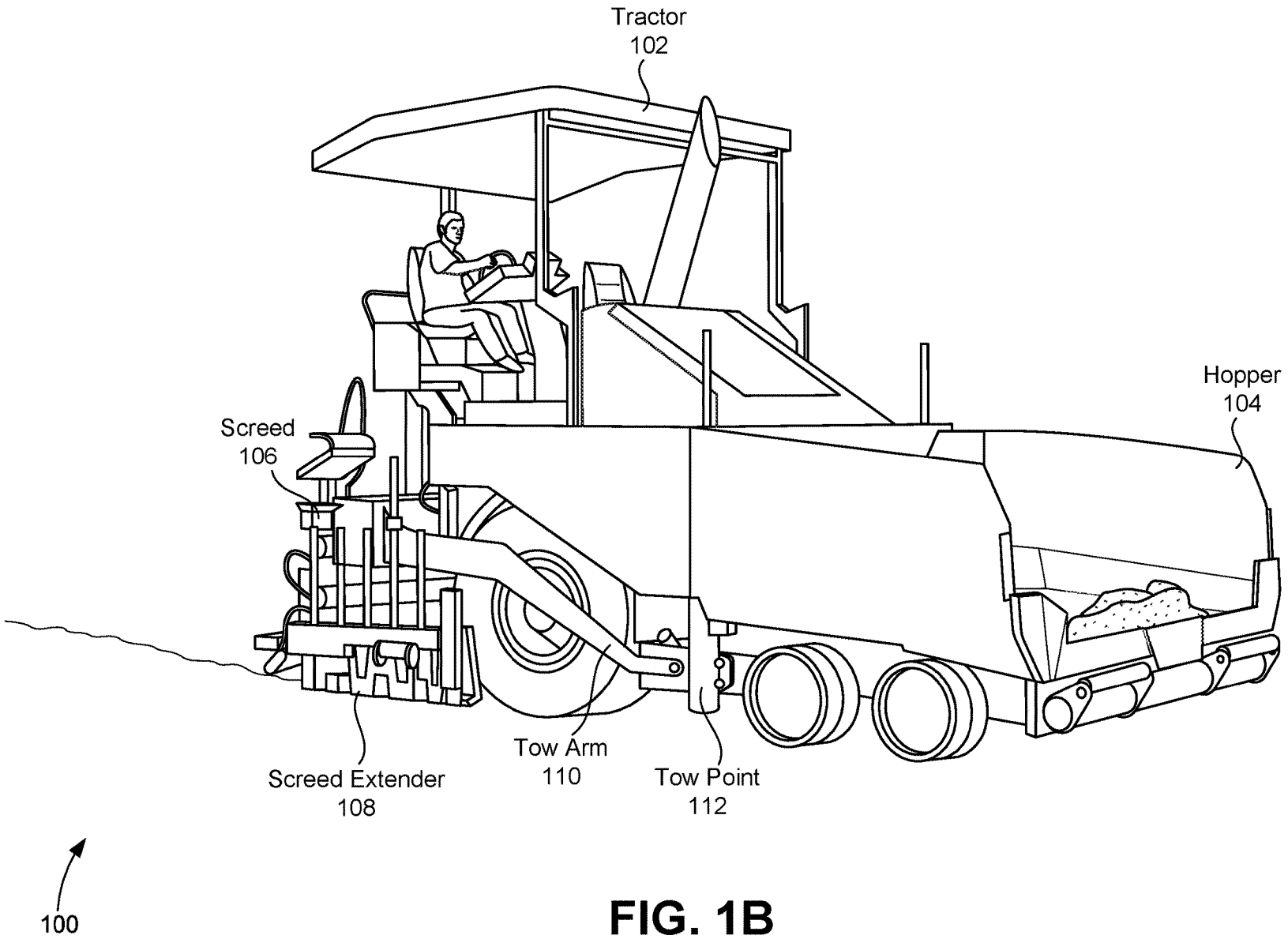

FIGS. 1A and 1B illustrate perspective views of an asphalt paver 100, according to some embodiments of the present disclosure. Asphalt paver 100 is a type of construction machine used to lay asphalt on roads, bridges, parking surfaces, and the like. The term "construction machine" as used herein may refer to asphalt paver 100 or to any one of a number of different types of construction machines, including pavers (e.g., concrete, asphalt, slipform, vibratory, etc.), graders, compactors, excavators, scrapers, loaders, etc., each of which may have components similar to those described in reference to asphalt paver 100.

Asphalt paver 100 may include a tractor 102 where one or more operators of asphalt paver 100 may control the construction machine using various input devices such as computers, levers, switches, buttons, etc. Input devices may alternatively or additionally be located at other locations throughout asphalt paver 100. Tractor 102 may include an engine, axels, wheels, and other components allowing movement of asphalt paver 100 along a desired path, often at a constant speed. Asphalt paver 100 may include a hopper 104 mechanically coupled to (or integrated with) tractor 102. Asphalt (or the material being laid) may be added to hopper 104 by a dump truck or a material transfer device while asphalt paver 100 is stationary or during operation of asphalt paver 100, such that asphalt may be added concurrently with moving and laying asphalt.

Asphalt paver 100 may include a screed 106 that is mechanically coupled to tractor 102 via one or more tow arms 110. The term "implement" as used herein may refer to screed 106 or to any one of a number of different types of implements that may be dragged behind or pushed in front of a construction machine. Screed 106 may receive the stockpile of material from hopper 104 and spread it over the width of screed 106. The material may pass through an auger which places it in front of or in the middle of screed 106. In some embodiments, it is desirable to provide a smooth uniform surface of asphalt behind screed 106 which may be obtained by causing screed 106 to be free floating above the ground. Using tow arms 110, a slope associated with screed 106 may be adjusted by a control system to improve the smoothness of the laid asphalt.

The width of screed 106 may be adjusted by moving (e.g., extending or retracting) a screed extender 108, which may be included on a single side or on both the right and left side of screed 106. As used herein, screed extender 108 may be considered to be "moving" when it is being extended or retracted from screed 106 in the transverse direction, independent of whether asphalt paver 100 as a whole is moving forward. When equipped on both sides of screed 106, screed extenders 108 may double the effective width of screed 106, increasing the efficiency of a paving operation. Movement of screed extender 108 is caused by one or more extender actuators 166 located within screed 106. In one particular implementation, extender actuator 166 may be a hydraulic cylinder. In other embodiments, or in the same embodiments, extender actuator 166 may comprise any type of hydraulic, pneumatic, electric, magnetic, and/or mechanical actuator. Screed extender 108 may be moved while asphalt paver 100 is stationary, driving forward, accelerating, and/or turning. For example, as shown in FIG. 1A, screed extender 108 may be extended during a first portion of a paving operation and, as shown in FIG. 1B, may be subsequently retracted.

The height and slope of screed 106 (i.e., the angle formed by screed 106 with respect to the transverse direction) may be controlled by moving tow arms 110. In some embodiments, movement of tow arms 110 is caused by one or more tow arm actuators 164 located at tow point 112. In one particular implementation, tow arm actuator 164 may be a hydraulic cylinder. In other embodiments, or in the same embodiments, tow arm actuator 164 may comprise any type of hydraulic, pneumatic, electric, magnetic, and/or mechanical actuator.

Figure 2:
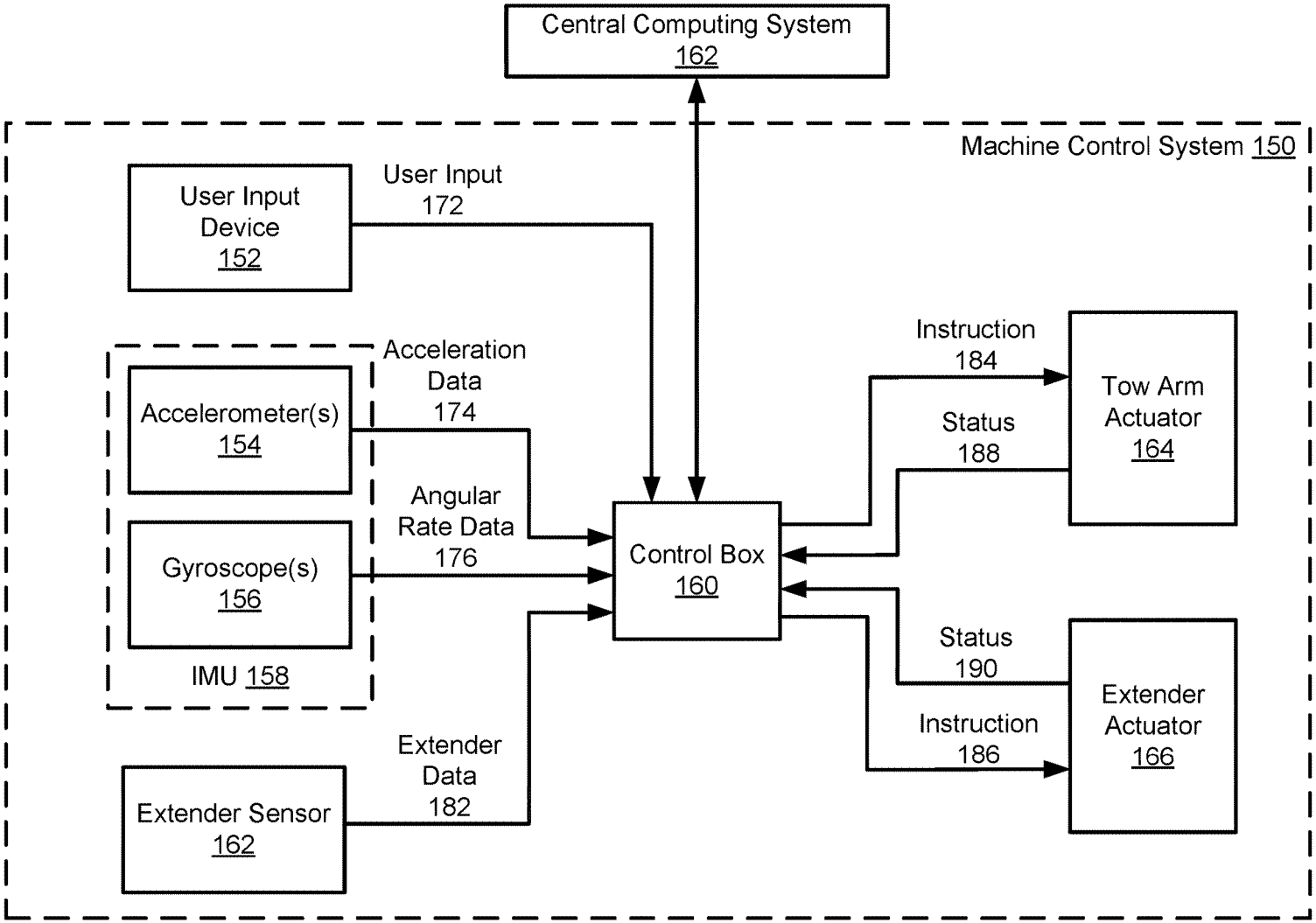
FIG. 2 illustrates a schematic view of a machine control system, according to some embodiments of the present disclosure.

FIG. 2 illustrates a schematic view of a machine control system 150, according to some embodiments of the present disclosure. Machine control system 150 includes various sensors, input devices, actuators, and processors for allowing an operator of asphalt paver 100 to complete a high-precision paving operation. The components of machine control system 150 may be mounted to or integrated with the components of asphalt paver 100 such that asphalt paver 100 may include machine control system 150. The components of machine control system 150 may be communicatively coupled to each other via any one of various possible wired or wireless connections.

Machine control system 150 may include a control box 160 that receives data from the various sensors and inputs and generates commands that are sent to the various actuators and output devices. Control box 160 may include one or more processors and an associated memory. In some embodiments, control box 160 may be communicatively coupled to a central computing system 162 located external to machine control system 150 and asphalt paver 100. Central computing system 162 may send instructions to control box 160 of the details of a paving operation, such as an area to be paved, a desired asphalt thickness, a desired grading, etc. Central computing system 162 may also send alerts and other general information to control box 160, such as traffic conditions, weather conditions, the locations and status of material transfer vehicles, and the like.

In some embodiments, machine control system 150 includes a user input device 152 for receiving a user input 172 from an operator of asphalt paver 100 and sending user input 172 to control box 160. User input device 152 may be a keyboard, a touchscreen, a touchpad, a switch, a lever, a button, a steering wheel, an acceleration pedal, a brake pedal, and the like. User input device 152 may be mounted to tractor 102, hopper 104, screed 106, or any other physical part of asphalt paver 100. In one implementation, user input device 152 may be a computing device mounted vertically to an outer edge of screed extender 108, allowing an operator of asphalt paver 100 to walk alongside the construction machine during a paving operation. User input 172 may indicate a desired movement of tractor 102, a desired movement of screed 106, a desired width of screed 106, a desired asphalt thickness, and the like.

Figure 3:
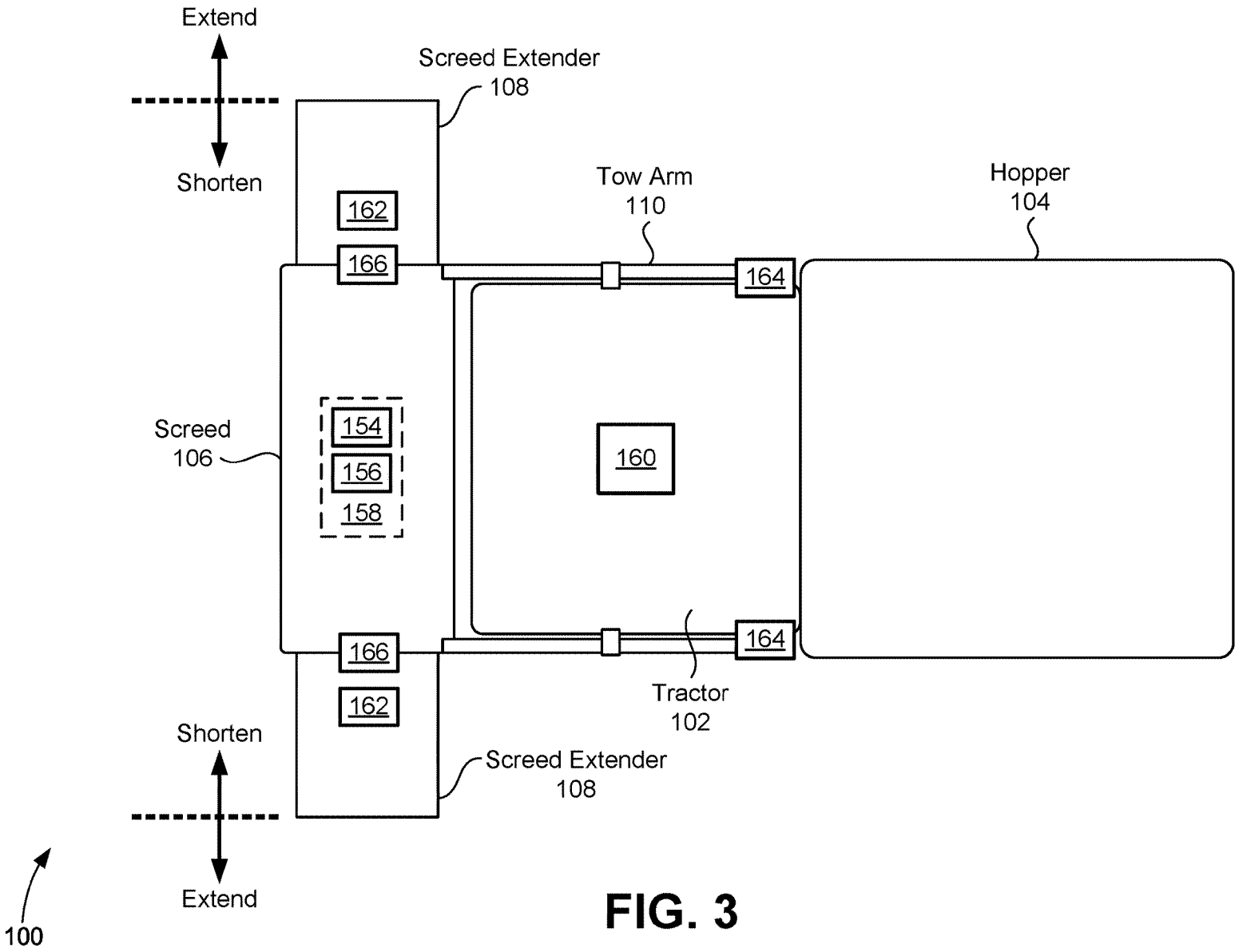
FIG. 3 illustrates a top view of an asphalt paver, according to some embodiments of the present disclosure.

In some embodiments, machine control system 150 includes an accelerometer 154 configured to generate acceleration data 174 corresponding to screed 106. The term "acceleration sensor" as used herein may refer to accelerometer 154 or to any one of a number of different types of acceleration-measuring and/or slope-measuring sensors, such as an inclinometer, tilt sensor, etc. Accelerometer 154 may be used by machine control system 150 to estimate a slope of screed 106. In some embodiments, acceleration data 174 directly includes an estimated slope of screed 106. In other embodiments, or in the same embodiments, acceleration data 174 includes raw data that is processed by control box 160 to generate an estimated slope of screed 106 by, for example, integrating raw or filtered acceleration measurements over a period of time. As shown in FIG. 3, accelerometer 154 may be directly mounted to screed 106.

In some embodiments, machine control system 150 includes a gyroscope 156 configured to generate angular rate data 176 corresponding to screed 106. The term "angular rate sensor" as used herein may refer to gyroscope 156 or to any one of a number of different types of angular rate-measuring sensors. Gyroscope 156 may be used by machine control system 150 in conjunction with accelerometer 154 to estimate a slope of screed 106. In some embodiments, angular rate data 176 directly includes an estimated slope of screed 106. In other embodiments, or in the same embodiments, angular rate data 176 includes raw data that is processed alongside acceleration data 174 by control box 160 to generate an estimated slope of screed 106 by, for example, integrating raw or filtered angular rate measurements over a period of time. As shown in FIG. 3, gyroscope 156 may be directly mounted to screed 106. In some embodiments, accelerometer 154 and gyroscope 156 are packaged together in an inertial measurement unit (IMU) 158 alongside additional sensors.

In some embodiments, machine control system 150 includes an extender sensor 162 configured to generate extender data 182 indicating whether screed extender 108 is moving and/or a current width of screed 106. In some embodiments, extender sensor 162 is a motion sensor (e.g., infrared, optics, vibration, magnetism) positioned such that movement of screed extender 108 may be detected. In some embodiments, extender sensor 162 monitors the inputs to extender actuator 166. As shown in FIG. 3, extender sensor 162 may be directly mounted to screed 106.

In some embodiments, machine control system 150 includes a tow arm actuator 164 configured to cause movement of tow arm 110. Tow arm actuator 164 may receive an instruction 184 from control box 160, which may be a direct current (DC) or alternating current (AC) voltage or, in some embodiments, may be an information-containing signal. Upon receiving instruction 184, tow arm actuator 164 may move according to a linear, rotatory, or oscillatory motion, among other possibilities. In some embodiments, tow arm actuator 164 may generate a status 188 that is sent to control box 160. Status 188 may indicate a current operating position of tow arm actuator 164 and/or a status of tow arm actuator 164.

In some embodiments, machine control system 150 includes an extender actuator 166 configured to cause movement of screed extender 108. Extender actuator 166 may receive an instruction 186 from control box 160, which may be a DC or AC voltage or, in some embodiments, may be an information-containing signal. Upon receiving instruction 186, extender actuator 166 may cause linear movement of screed extender 108 in the transverse direction. In some embodiments, extender actuator 166 may generate a status 190 that is sent to control box 160. Status 190 may indicate a current operating position of extender actuator 166 and/or a status of extender actuator 166.

FIG. 3 illustrates a top view of asphalt paver 100, according to some embodiments of the present disclosure. In the specific implementation shown in FIG. 3, asphalt paver 100 includes two screed extenders 108, two extender sensors 162, two extender actuators 166, two tow arms 110, and two tow arm actuators 164 located on left and right sides of asphalt paver 100.

Figure 4:
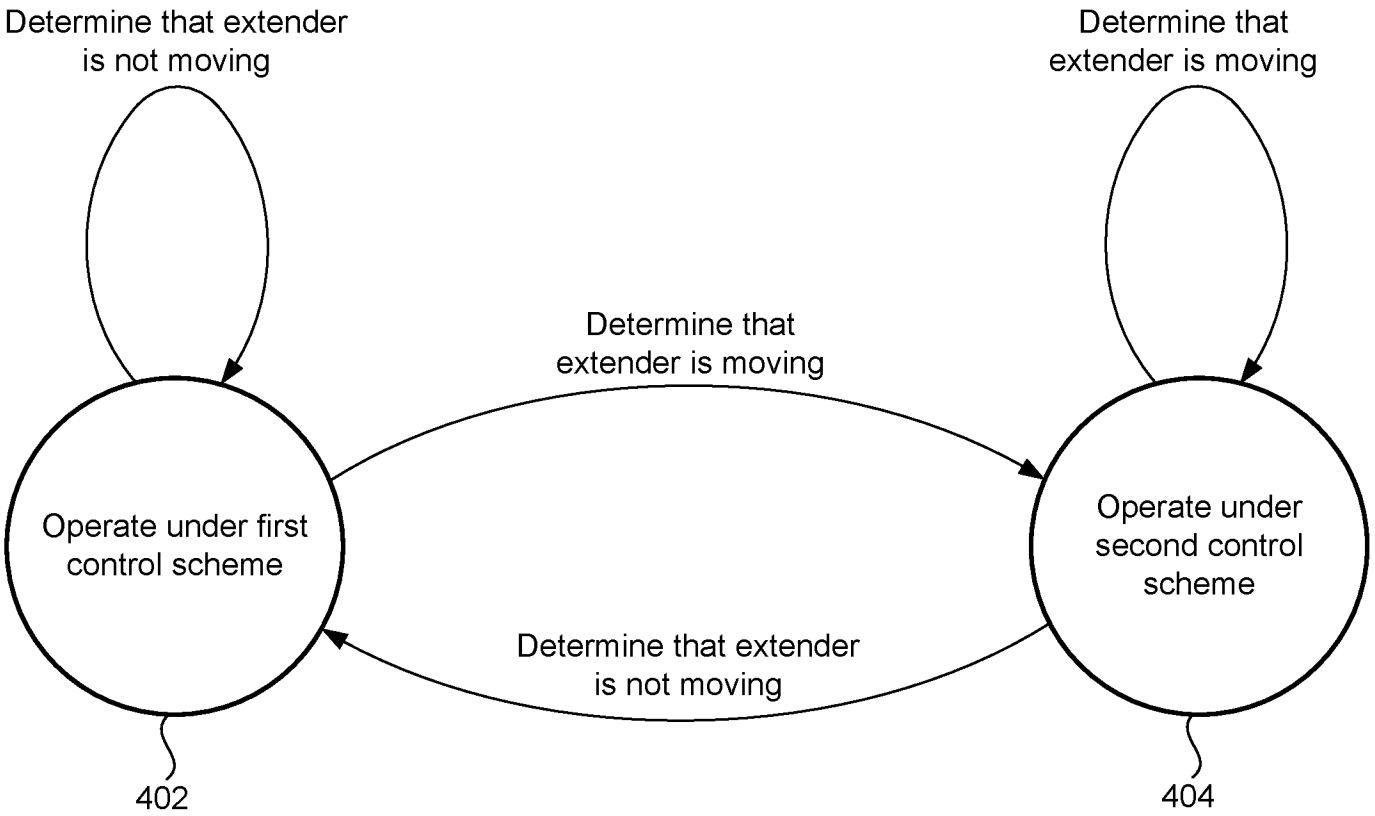
FIG. 4 illustrates a state diagram corresponding to a machine control system, according to some embodiments of the present disclosure.

FIG. 4 illustrates a state diagram corresponding to machine control system 150, according to some embodiments of the present disclosure. At state 402, machine control system 150 is operating under a first control scheme. While operating under the first control scheme, machine control system 150 may determine whether screed extender 108 is moving. If it is determined that screed extender 108 is not moving, machine control system 150 may continue to operate under the first control scheme. Otherwise, if it is determined that screed extender 108 is moving, a transition from state 402 to state 404 will occur, and machine control system 150 will begin operating under a second control scheme. While operating under the second control scheme, machine control system 150 may continue to determine whether screed extender 108 is moving. If it is determined that screed extender 108 is not moving, a transition from state 404 back to state 402 will occur. Otherwise, if it is determined that screed extender 108 is moving, machine control system 150 may continue to operate under the second control scheme.

In some embodiments, performance of the present invention is improved if the frequency at which it is determined whether screed extender 108 is moving is higher in state 404 than in state 402. For example, while operating under the first control scheme, machine control system 150 may determine whether screed extender 108 is moving at a first frequency (e.g., once every 1 second), and while operating under the second control scheme, machine control system 150 may determine whether screed extender 108 is moving at a second frequency that is higher than the first frequency (e.g., once every 0.1 seconds). In this manner, the amount of time that machine control system 150 operates under the second control scheme may be reduced.

Figure 5:
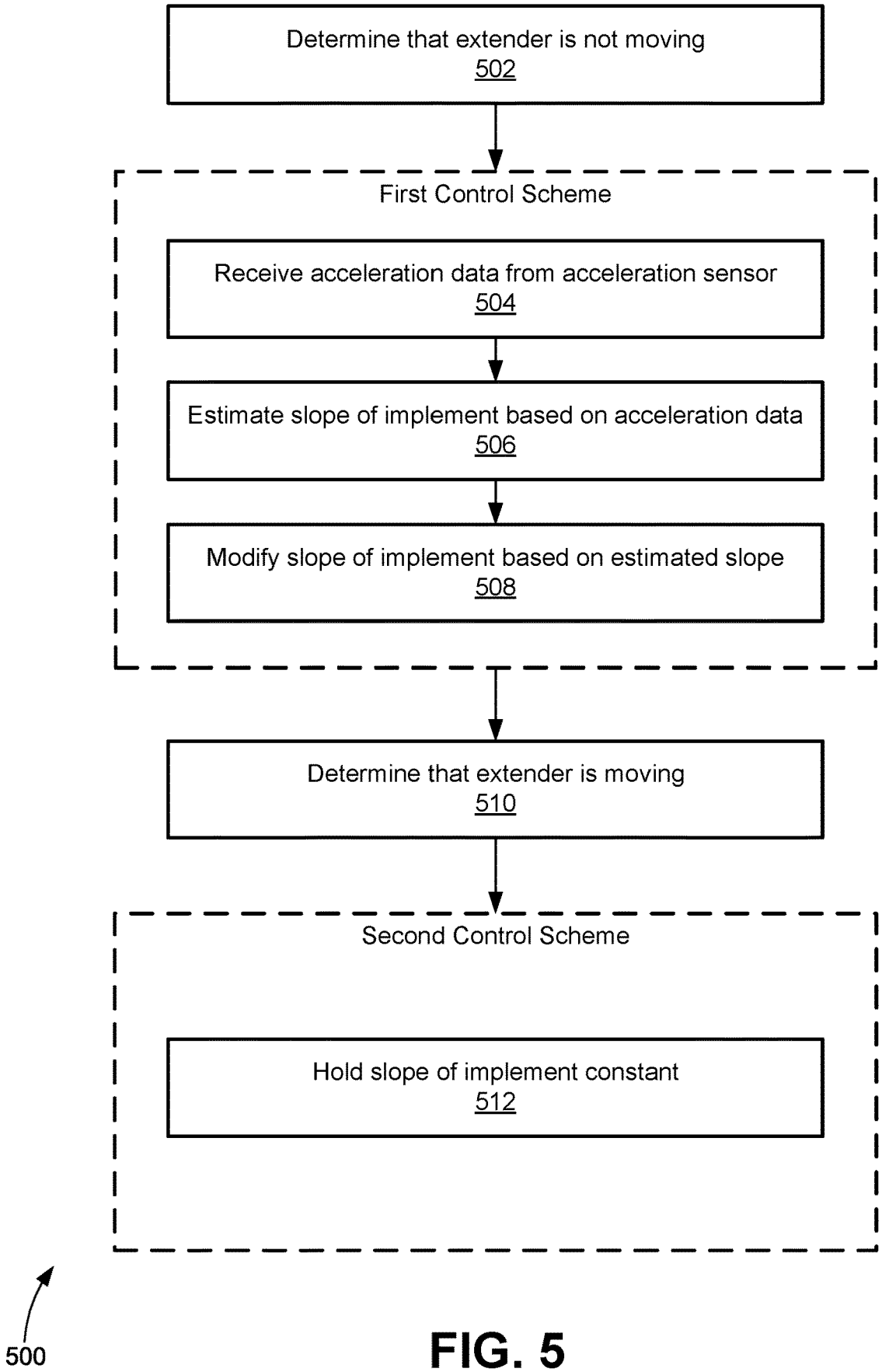
FIG. 5 illustrates a method of controlling an implement of a construction machine, according to some embodiments of the present disclosure.

FIG. 5 illustrates a method 500 of controlling an implement (e.g., screed 106) of a construction machine (e.g., asphalt paver 100), according to some embodiments of the present disclosure. Steps of method 500 need not be performed in the order shown, and not all steps need be performed during performance of method 500. One or more steps of method 500 may be performed or facilitated by one or more processors located within a control unit (e.g., control box 160) of the construction machine.

At step 502, it is determined that an extender (e.g., screed extender 108) of the implement is not moving (i.e., is not being extended or retracted). In some embodiments, determining that the extender is not moving may include one or more of: receiving user input (e.g., user input 172) from a user input device (e.g., user input device 152) to not move the extender, receiving extender data (e.g., extender data 182) from an extender sensor (e.g., extender sensor 162) mounted to the implement indicating that the extender is not moving, determining that an instruction (e.g., instruction 186) was sent to an extender actuator (e.g., extender actuator 166) to not move the extender, receiving a status (e.g., status 190) from the extender actuator that the extender is not moving, and analyzing acceleration data (e.g., acceleration data 174) to determine that the extender is not moving.

In response to determining that the extender is not moving, operation under a first control scheme may begin or continue. In some embodiments, operating under the first control scheme may include performing one or more of steps 504, 506, and 508. At step 504, acceleration data (e.g., acceleration data 174) is received from an acceleration sensor (e.g., accelerometer 154) mounted to the implement. The acceleration sensor may send the acceleration data in response to a request, or the acceleration sensor may send the acceleration data periodically or upon availability of the acceleration data.

At step 506, a first estimated slope of the implement is generated based on the acceleration data. The acceleration data may directly include the first estimated slope or the acceleration data may include raw data that is processed to generate the first estimated slope.

At step 508, a slope of the implement is modified based on the first estimated slope. In some embodiments, the slope of the implement is caused to increase or decrease toward a desired slope so as to increase the smoothness of a material that is laid by the implement. For example, if the first estimated slope is greater than a desired slope, then the slope of the implement may be caused to decrease toward the desired slope. Similarly, if the first estimated slope is less than a desired slope, then the slope of the implement may be caused to increase toward the desired slope. In some embodiments, modifying the slope of the implement includes causing movement of a tow arm (e.g., tow arm 110) mechanically coupled to the implement so as to modify the slope of the implement.

At step 510, it is determined that the extender is moving (e.g., is being extended or retracted). In some embodiments, determining that the extender is moving may include one or more of: receiving the user input from the user input device to move the extender, receiving the extender data from the extender sensor mounted to the implement indicating that the extender is moving, determining that the instruction was sent to the extender actuator to move the extender, receiving the status from the extender actuator that the extender is moving, and analyzing the acceleration data to determine that the extender is moving.

In response to determining that the extender is moving, operation under a second control scheme may begin or continue. In some embodiments, operating under the second control scheme may include performing step 512. At step 512, the slope of the implement is maintained substantially constant, which may include maintaining the slope of the implement within a threshold of its previous value (e.g., within 0.1%, 1%, 2%, and the like). In some embodiments, the tow arms are locked from moving during performance of step 512 such that the slope of the implement is maintained constant. In some embodiments, the tow arms may be moved during performance of step 512 to maintain a constant slope (e.g., the height of the implement may be adjusted while maintaining a constant slope). In some embodiments, all control systems and/or control programs associated with controlling the slope of the implement are paused or disabled during performance of step 512. In some embodiments, new acceleration data is not received during performance of step 512. In some embodiments, the slope of the implement is maintained constant by maintaining the first estimated slope and/or the desired slope constant. Other possibilities are contemplated.

Figure 6:
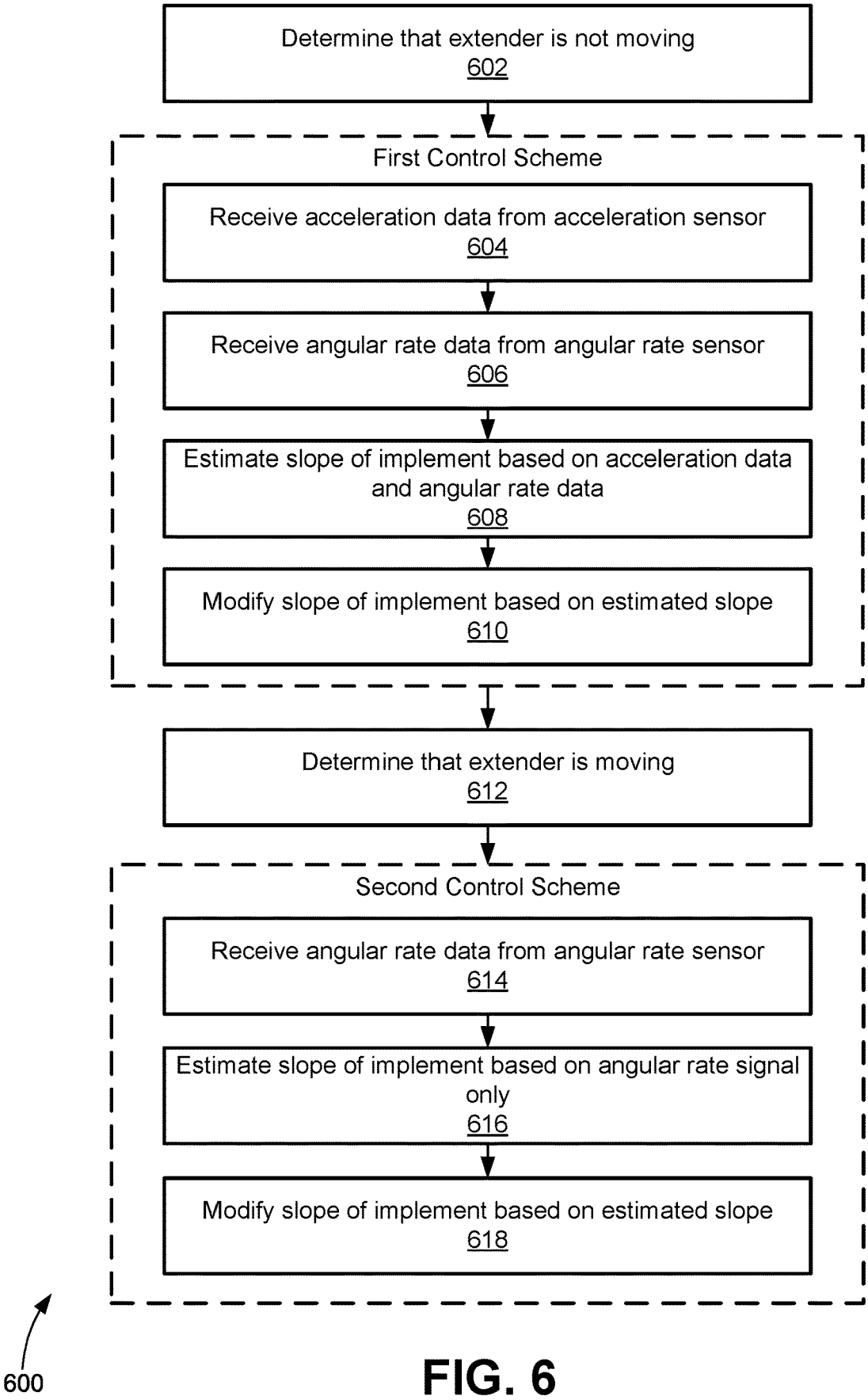
FIG. 6 illustrates a method of controlling an implement of a construction machine, according to some embodiments of the present disclosure.

FIG. 6 illustrates a method 600 of controlling an implement (e.g., screed 106) of a construction machine (e.g., asphalt paver 100), according to some embodiments of the present disclosure. One or more steps of method 600 may be similar to one or more steps of method 500. Steps of method 600 need not be performed in the order shown, and not all steps need be performed during performance of method 600. One or more steps of method 600 may be performed or facilitated by one or more processors located within a control unit (e.g., control box 160) of the construction machine.

At step 602, it is determined that an extender (e.g., screed extender 108) of the implement is not moving (i.e., is not being extended or retracted). In some embodiments, determining that the extender is not moving may include one or more of: receiving user input (e.g., user input 172) from a user input device (e.g., user input device 152) to not move the extender, receiving extender data (e.g., extender data 182) from an extender sensor (e.g., extender sensor 162) mounted to the implement indicating that the extender is not moving, determining that an instruction (e.g., instruction 186) was sent to an extender actuator (e.g., extender actuator 166) to not move the extender, receiving a status (e.g., status 190) from the extender actuator that the extender is not moving, and analyzing acceleration data (e.g., acceleration data 174) and/or angular rate data (e.g., angular rate data 176) to determine that the extender is not moving.

In response to determining that the extender is not moving, operation under a first control scheme may begin or continue. In some embodiments, operating under the first control scheme may include performing one or more of steps 604, 606, 608, and 610. At step 604, acceleration data (e.g., acceleration data 174) is received from an acceleration sensor (e.g., accelerometer 154) mounted to the implement. The acceleration sensor may send the acceleration data in response to a request, or the acceleration sensor may send the acceleration data periodically or upon availability of the acceleration data.

At step 606, first angular rate data (e.g., angular rate data 176) is received from an angular rate sensor (e.g., gyroscope 156) mounted to the implement. The angular rate sensor may send the first angular rate data in response to a request, or the angular rate sensor may send the first angular rate data periodically or upon availability of the first angular rate data.

At step 608, a first estimated slope of the implement is generated based on the acceleration data and/or the first angular rate data. The acceleration data and/or the first angular rate data may directly include the first estimated slope or the acceleration data and/or the first angular rate data may include raw data that is processed to generate the first estimated slope.

At step 610, a slope of the implement is modified based on the first estimated slope. Step 610 may include similar steps to those described in reference to step 508.

At step 612, it is determined that the extender is moving (e.g., is being extended or retracted). In some embodiments, determining that the extender is moving may include one or more of: receiving the user input from the user input device to move the extender, receiving the extender data from the extender sensor mounted to the implement indicating that the extender is moving, determining that the instruction was sent to the extender actuator to move the extender, receiving the status from the extender actuator that the extender is moving, and analyzing the acceleration data and/or the angular rate data to determine that the extender is moving.

In response to determining that the extender is moving, operation under a second control scheme may begin or continue. In some embodiments, operating under the second control scheme may include performing steps 614, 616, and 618. At step 614, second angular rate data is received from the angular rate sensor. The angular rate sensor may send the second angular rate data in response to a request, or the angular rate sensor may send the second angular rate data periodically or upon availability of the second angular rate data.

At step 616, a second estimated slope of the implement is generated based on the second angular rate data. The second angular rate data may directly include the second estimated slope or the second angular rate data may include raw data that is processed to generate the second estimated slope. The second estimated slope may be generated while completely (or almost completely) ignoring acceleration data. This may be accomplished by weighing any acceleration data-related slope estimate by less than 10% compared to a slope estimate based on angular rate data (or, in some embodiments, 20%, 30%, or 40% compared to the slope estimate based on angular rate data).

In some embodiments, all or most of acceleration data is ignored while operating under the second control scheme due to the significant amount of noise caused by movement of the extender. While the noise due to extender movement affects slope estimates based on acceleration data, the slope of the extender may continue to be accurately estimated using only angular rate data for a short period of time (e.g., on the order of seconds). Relying on only angular rate data for longer than certain thresholds of time (e.g., 10 seconds) may cause the slope estimate to significantly deviate from the actual slope of the implement.

At step 618, the slope of the implement is modified based on the second estimated slope. Step 618 may include similar steps to those described in reference to step 508.

Figure 7:
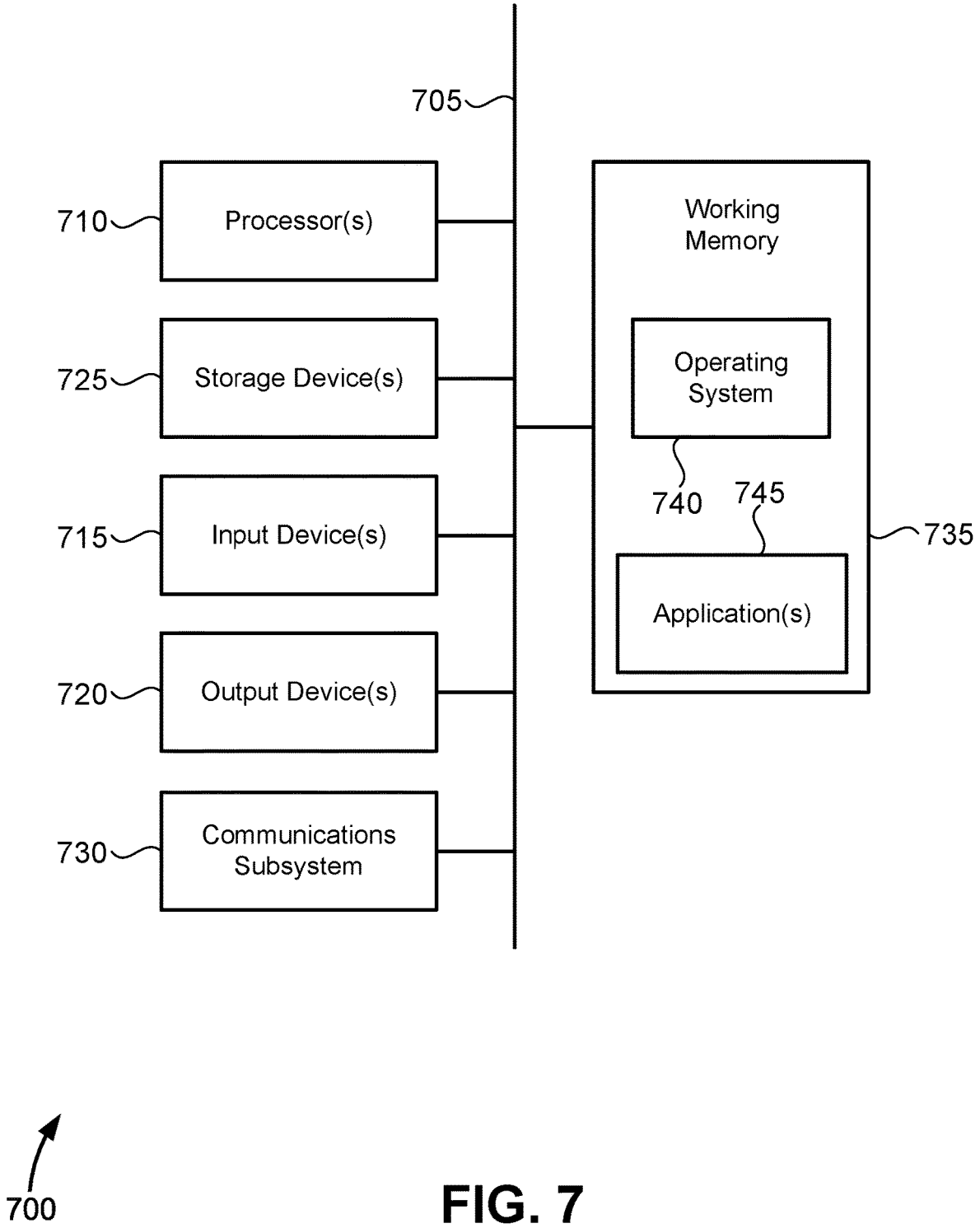
FIG. 7 illustrates a simplified computer system, according to some embodiments of the present disclosure.

FIG. 7 illustrates a simplified computer system 700, according to some embodiments of the present disclosure. Computer system 700 as illustrated in FIG. 7 may be incorporated into devices such as control box 160, central computing system 162, user input device 152, accelerometer 154, gyroscope 156, or some other device described herein. FIG. 7 provides a schematic illustration of one embodiment of computer system 700 that can perform some or all of the steps of the methods provided by various embodiments. It should be noted that FIG. 7 is meant only to provide a generalized illustration of various components, any or all of which may be utilized as appropriate. FIG. 7, therefore, broadly illustrates how individual system elements may be implemented in a relatively separated or more integrated manner.

Computer system 700 is shown comprising hardware elements that can be electrically coupled via a bus 705, or may otherwise be in communication, as appropriate. The hardware elements may include one or more processors 710, including without limitation one or more general-purpose processors and/or one or more special-purpose processors such as digital signal processing chips, graphics acceleration processors, and/or the like; one or more input devices 715, which can include, without limitation a mouse, a keyboard, a camera, and/or the like; and one or more output devices 720, which can include, without limitation a display device, a printer, and/or the like.

Computer system 700 may further include and/or be in communication with one or more non-transitory storage devices 725, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

Computer system 700 might also include a communications subsystem 730, which can include, without limitation a modem, a network card (wireless or wired), an infrared communication device, a wireless communication device, and/or a chipset such as a Bluetooth™ device, an 802.11 device, a WiFi device, a WiMax device, cellular communication facilities, etc., and/or the like. The communications subsystem 730 may include one or more input and/or output communication interfaces to permit data to be exchanged with a network such as the network described below to name one example, to other computer systems, and/or any other devices described herein. Depending on the desired functionality and/or other implementation concerns, a portable electronic device or similar device may communicate image and/or other information via the communications subsystem 730. In other embodiments, a portable electronic device, e.g. the first electronic device, may be incorporated into computer system 700, e.g., an electronic device as an input device 715. In some embodiments, computer system 700 will further comprise a working memory 735, which can include a RAM or ROM device, as described above.

Computer system 700 also can include software elements, shown as being currently located within the working memory 735, including an operating system 740, device drivers, executable libraries, and/or other code, such as one or more application programs 745, which may comprise computer programs provided by various embodiments, and/or may be designed to implement methods, and/or configure systems, provided by other embodiments, as described herein. Merely by way of example, one or more procedures described with respect to the methods discussed above can be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 725 described above. In some cases, the storage medium might be incorporated within a computer system, such as computer system 700. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by computer system 700 and/or might take the form of source and/or installable code, which, upon compilation and/or installation on computer system 700 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware or software including portable software, such as applets, etc., or both. Further, connection to other computing devices such as network input/output devices may be employed.

As mentioned above, in one aspect, some embodiments may employ a computer system such as computer system 700 to perform methods in accordance with various embodiments of the technology. According to a set of embodiments, some or all of the procedures of such methods are performed by computer system 700 in response to processor 710 executing one or more sequences of one or more instructions, which might be incorporated into the operating system 740 and/or other code, such as an application program 745, contained in the working memory 735. Such instructions may be read into the working memory 735 from another computer-readable medium, such as one or more of the storage device(s) 725. Merely by way of example, execution of the sequences of instructions contained in the working memory 735 might cause the processor(s) 710 to perform one or more procedures of the methods described herein.

Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using computer system 700, various computer-readable media might be involved in providing instructions/code to processor(s) 710 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 725. Volatile media include, without limitation, dynamic memory, such as the working memory 735.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 710 for execution. Merely by way of example, the instructions may initially be carried on a magnetic disk and/or optical disc of a remote computer. A remote computer might load the instructions into its dynamic memory and send the instructions as signals over a transmission medium to be received and/or executed by computer system 700.

The communications subsystem 730 and/or components thereof generally will receive signals, and the bus 705 then might carry the signals and/or the data, instructions, etc. carried by the signals to the working memory 735, from which the processor(s) 710 retrieves and executes the instructions. The instructions received by the working memory 735 may optionally be stored on a non-transitory storage device 725 either before or after execution by the processor(s) 710.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a schematic flowchart or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A construction machine comprising:
a tractor;
a hopper coupled to the tractor;
an implement coupled to the tractor via at least one tow arm, the implement having an extender;
an acceleration sensor mounted to the implement;
one or more processors configured to perform operations comprising:
determining that the extender is not moving;
in response to determining that the extender is not moving, operating under a first control scheme, wherein operating under the first control scheme includes:
receiving acceleration data from the acceleration sensor;
generating a first estimated slope of the implement based on the acceleration data; and
modifying a slope of the implement based on the first estimated slope by causing movement of the at least one tow arm;
determining that the extender is moving; and
in response to determining that the extender is moving, operating under a second control scheme, wherein operating under the second control scheme includes:
maintaining the slope of the implement substantially constant.

2. The construction machine of claim 1, wherein:
the construction machine is an asphalt paver;
the implement is a screed;
the extender is a screed extender; and
the acceleration sensor is an accelerometer.

3. The construction machine of claim 1, wherein maintaining the slope of the implement substantially constant includes locking the at least one tow arm.

4. The construction machine of claim 1, wherein maintaining the slope of the implement substantially constant includes not receiving new acceleration data from the acceleration sensor.

5. The construction machine of claim 1, wherein maintaining the slope of the implement substantially constant includes not generating a new estimated slope of the implement.

6. A construction machine comprising:
an implement having an extender;
an acceleration sensor mounted to the implement;
one or more processors configured to perform operations comprising:
operating under a first control scheme, wherein operating under the first control scheme includes:
receiving acceleration data from the acceleration sensor;
generating a first estimated slope of the implement based on the acceleration data; and
modifying a slope of the implement based on the first estimated slope;
determining that the extender is moving; and
in response to determining that the extender is moving, operating under a second control scheme, wherein the second control scheme includes at least one operation that is different than an operation of the first control scheme.

7. The construction machine of claim 6, wherein the operations further comprise:

determining that the extender is not moving; and in response to determining that the extender is not moving, operating under the first control scheme.

8. The construction machine of claim 6, wherein modifying the slope of the implement includes:

causing movement of a tow arm mechanically coupled to the implement so as to modify the slope of the implement.

9. The construction machine of claim 6, wherein operating under the second control scheme includes:

maintaining the slope of the implement substantially constant.

10. The construction machine of claim 6, further comprising:

an angular rate sensor mounted to the implement.

11. The construction machine of claim 10, wherein:

operating under the first control scheme further includes:

receiving first angular rate data from the angular rate sensor mounted to the implement; and generating the first estimated slope of the implement based on one or both of the acceleration data and the first angular rate data; and operating under the second control scheme includes:

receiving second angular rate data from the angular rate sensor;

generating a second estimated slope of the implement based on the second angular rate data but not on data received from the acceleration sensor; and modifying the slope of the implement based on the second estimated slope.

12. The construction machine of claim 6, wherein determining that the extender is moving includes one or more of:

receiving user input from a user input device to move the extender;

receiving extender data from an extender sensor mounted to the implement indicating that the extender is moving;

determining that an instruction was sent to an extender actuator to move the extender;

receiving a status from the extender actuator that the extender is moving; and analyzing the acceleration data to determine that the extender is moving.

13. The construction machine of claim 6, wherein:

the construction machine is an asphalt paver;

the implement is a screed;

the extender is a screed extender;

the acceleration sensor is an accelerometer; and the angular rate sensor is a gyroscope.

14. A method of controlling an implement of a construction machine, the method comprising:

operating under a first control scheme, wherein operating under the first control scheme includes:

receiving acceleration data from an acceleration sensor mounted to the implement;

generating a first estimated slope of the implement based on the acceleration data; and modifying a slope of the implement based on the first estimated slope;

determining that an extender of the implement is moving; and in response to determining that the extender is moving, operating under a second control scheme, wherein the second control scheme includes at least one operation that is different than an operation of the first control scheme.

15. The method of claim 14, further comprising:

determining that the extender is not moving; and in response to determining that the extender is not moving, operating under the first control scheme.

16. The method of claim 14, wherein modifying the slope of the implement includes:

causing movement of a tow arm mechanically coupled to the implement so as to modify the slope of the implement.

17. The method of claim 14, wherein operating under the second control scheme includes:

maintaining the slope of the implement substantially constant.

18. The method of claim 14, wherein:

operating under the first control scheme further includes:

receiving first angular rate data from an angular rate sensor mounted to the implement; and generating the first estimated slope of the implement based on one or both of the acceleration data and the first angular rate data; and operating under the second control scheme includes:

receiving second angular rate data from the angular rate sensor;

generating a second estimated slope of the implement based on the second angular rate data but not on data received from the acceleration sensor; and modifying the slope of the implement based on the second estimated slope.

19. The method of claim 14, wherein determining that the extender is moving includes one or more of:

receiving user input from a user input device to move the extender;

receiving extender data from an extender sensor mounted to the implement indicating that the extender is moving;

determining that an instruction was sent to an extender actuator to move the extender;

receiving a status from the extender actuator that the extender is moving; and analyzing the acceleration data to determine that the extender is moving.

20. The method of claim 14, wherein:

the construction machine is an asphalt paver;

the implement is a screed;

the extender is a screed extender;

the acceleration sensor is an accelerometer; and the angular rate sensor is a gyroscope.

* * * * *